US009664457B2

(12) United States Patent
Takada et al.

(10) Patent No.: US 9,664,457 B2
(45) Date of Patent: May 30, 2017

(54) TOTAL HEAT EXCHANGE ELEMENT AND MANUFACTURING METHOD THEREOF

(75) Inventors: Masaru Takada, Tokyo (JP); Shinya Tokizaki, Tokyo (JP); Hajime Sotokawa, Tokyo (JP); Yuichi Ishimaru, Tokyo (JP); Takanori Imai, Tokyo (JP); Hidemoto Arai, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 551 days.

(21) Appl. No.: 14/347,469

(22) PCT Filed: Oct. 26, 2011

(86) PCT No.: PCT/JP2011/074666

§ 371 (c)(1),
(2), (4) Date: Mar. 26, 2014

(87) PCT Pub. No.: WO2013/061419

PCT Pub. Date: May 2, 2013

(65) Prior Publication Data

US 2014/0242900 A1 Aug. 28, 2014

(51) Int. Cl.
*F24F 7/00* (2006.01)
*F24F 13/08* (2006.01)
(Continued)

(52) U.S. Cl.
CPC ..... *F28F 3/08* (2013.01); *F24F 13/02* (2013.01); *F28D 9/0037* (2013.01);
(Continued)

(58) Field of Classification Search
CPC ..... F28F 3/08; F28D 9/0037; F28D 9/0062; F28D 21/0015; F24F 13/02
See application file for complete search history.

(56) References Cited

U.S. PATENT DOCUMENTS 6,019,170 A * 2/2000 Yokoya ..... F28D 9/0062 165/166
7,299,862 B2 * 11/2007 Takada ..... F24F 3/147 165/133
(Continued)

FOREIGN PATENT DOCUMENTS

JP 47-19990 6/1972
JP 51-2131 1/1976
(Continued)

OTHER PUBLICATIONS

Chinese Office Action dated Apr. 1, 2016 issued in corresponding Chinese Patent Appln. No. 201180074354.5, with English translation (8 pages).
(Continued)

*Primary Examiner* — Steven B McAllister
*Assistant Examiner* — Jonathan Cotov
(74) *Attorney, Agent, or Firm* — Buchanan Ingersoll & Rooney PC

(57) ABSTRACT

The present invention is a total heat exchange element in which a spacing member is provided on both sides of a sheet-like partition member to form a flow path and which performs heat exchange between an airflow that flows in a flow path formed on one side of the partition member and an airflow that flows in a flow path formed on another side of the partition member via the partition member, wherein the spacing member is molded integrally with the partition member by using a resin, and the partition member is configured to include a functional layer that has heat conductivity, moisture permeability, and gas shielding property and a heat shrink layer that shrinks at a predetermined temperature or higher.

8 Claims, 4 Drawing Sheets

(51) Int. Cl.

| | |
|---|---|
| ***F28F 3/08*** | (2006.01) |
| ***F28F 21/06*** | (2006.01) |
| ***F28D 9/00*** | (2006.01) |
| ***F28D 21/00*** | (2006.01) |
| ***F24F 13/02*** | (2006.01) |

(52) U.S. Cl.
CPC ..... *F28D 21/0015* (2013.01); *F28F 21/06* (2013.01); *Y10T 29/4935* (2015.01)

(56) References Cited

U.S. PATENT DOCUMENTS

| | | | | |
|---|---|---|---|---|
| 8,550,151 | B2 * | 10/2013 | Murayama | F24F 3/147 165/133 |
| 8,684,274 | B2 * | 4/2014 | Vafai | B01J 19/0093 165/46 |
| 8,920,699 | B2 * | 12/2014 | Marutani | B29C 45/0055 264/271.1 |
| 2005/0082045 | A1 | 4/2005 | Takada et al. | |
| 2007/0221366 | A1 * | 9/2007 | Murayama | F28F 3/048 165/166 |
| 2008/0047699 | A1 | 2/2008 | Takada et al. | |

FOREIGN PATENT DOCUMENTS

| | | | | |
|---|---|---|---|---|
| JP | 07-208890 | A | | 8/1995 |
| JP | 2690272 | B2 | | 8/1997 |
| JP | 10-54691 | A | | 2/1998 |
| JP | 3461697 | B2 | | 8/2003 |
| JP | 2006-29692 | A | | 2/2006 |
| JP | 2006-97958 | A | | 4/2006 |
| JP | 2006097958 | A | * | 4/2006 |
| JP | 2006-207092 | A | | 8/2006 |
| JP | 2007-100997 | A | | 4/2007 |
| JP | 4449529 | B2 | | 2/2010 |
| JP | 2013-257106 | A | | 12/2013 |
| JP | 2013-257107 | A | | 12/2013 |
| KR | 10-2005-0036705 | A | | 4/2005 |
| WO | WO 2013/157055 | A1 | | 10/2013 |

OTHER PUBLICATIONS

Office Action (Notification of Reason for Refusal) issued on Mar. 17, 2015, by the Korean Intellectual Property Office in corresponding Korean Patent Application No. 10-2014-7009527, and an English Translation of the Office Action (6 pages).

Japanese Office Action dated Aug. 19, 2014 issued in corresponding Japanese Patent Appln. No. 2013-540543, with English translation (4 pages).

International Search Report (PCT/ISA/210) mailed on Feb. 7, 2012, by the Japanese Patent Office as the International Searching Authority for International Application No. PCT/JP2011/074666.

Written Opinion (PCT/ISA/237) mailed on Feb. 7, 2012, by the Japanese Patent Office as the International Searching Authority for International Application No. PCT/JP2011/074666.

Office Action (Third Office Action) issued on Sep. 23, 2016, by the State Intellectual Property Office of the People's Republic of China in corresponding Chinese Patent Application No. 201180074354.5 and partial English Translation of the Office Action. (9 pages).

* cited by examiner

TOTAL HEAT EXCHANGE ELEMENT AND MANUFACTURING METHOD THEREOF

FIELD

The present invention relates to a heat exchange element having a stacked structure that is provided in an air conditioner and performs heat exchange between fluids and to a manufacturing method thereof.

BACKGROUND

In recent years, with the development and spreading of air conditioners, such as heaters and coolers, and the increase of accommodation spaces where air conditioning devices are used, the importance of a total heat exchanger for an air conditioner that can collect the temperature and humidity through ventilation has also become increased. A total heat exchange element is incorporated in such a total heat exchanger as an element that performs heat exchange.

As the total heat exchange element, for example, total heat exchange elements disclosed in Patent Literatures 1 and 2 have been widely employed. These total heat exchange elements include partition members having heat conductivity and moisture permeability and spacing members each of which is sandwiched between the partition members to maintain a distance between the partition members. The total heat exchange elements have a basic configuration in which the partition member and the spacing member are stacked in multiple layers.

For example, the partition member is a rectangular flat plate. The spacing member is a corrugated plate whose projection plane matches the partition member and which is shaped to have a saw-tooth, sinusoidal, or substantially triangular cross-sectional waveform. The partition member and the spacing member are stacked such that the directions of the waveforms of the spacing members between which the partition member is sandwiched are alternately changed by 90 degrees or approximately 90 degrees. With such a configuration, two fluid paths, that is, a flow path through which a primary airflow passes and a flow path through which a secondary airflow passes are alternately constituted between respective layers of the total heat exchange element. That is, the primary airflow passes along one surface side of the partition member and the secondary airflow passes along the other surface side thereof.

Characteristics required for the partition member of the total heat exchange element are low air permeability between fluid paths through which the primary airflow and the secondary airflow respectively pass, high heat conductivity, and high moisture permeability. These characteristics are required to prevent fresh outdoor air taken from the outdoors into the indoors from being mixed with dirty air to be discharged to the outdoors from the indoors and to allow not only sensible heat but also latent heat to be exchanged between the primary airflow and the secondary airflow when a total heat exchanger is used. Furthermore, it is desirable that the ventilation resistance (also referred to as "pressure loss" or "static pressure loss") when the respective airflows pass the flow paths is as low as possible. This is required to reduce power consumption of a blowing device (such as a fan and a blower) that causes an airflow to flow for ventilation and to reduce operating noise of the total heat exchanger.

As one of attempts to satisfy these required characteristics, for example, Patent Literature 3 discloses a configuration in which injection molding is applied to insert mold the partition member with a resin. With such a configuration, the area ratio of the spacing member (a resin part) to the partition member is reduced to secure heat exchange efficiency, and simultaneously the cross section of a flow path is formed in a rectangular shape to reduce the ventilation resistance.

According to such a method of using injection molding, the partition member deflects under a high humidity condition and the height of the flow path becomes uneven in the side of the primary airflow and the side of the secondary airflow, so that the ventilation resistance may be increased. Because the ventilation resistance is easily increased particularly when the height of a flow path is low, this may become an obstacle when reducing the height of a flow path and increasing the heat transfer area of a heat exchange element as a way of improving the heat exchange efficiency.

In Patent Literature 4, to solve the problem of the resistance of a flow path being increased under a high humidity condition, a moisture-permeable polyethylene-based film that is highly crystalline and has a good dimensional stability even in a high humidity condition and a paper having the resin mixed therewith are used as the partition member. However, when the moisture-permeable polyethylene-based film is used, there is a problem that, after a molded product has been removed, the film is warped or shrinks easily, and therefore the resin of the spacing member is deformed and shrinks after being demolded, so that insert-molded partition member and spacing member are deflected. As a result, the ventilation resistance may be increased.

In Patent Literature 5, it is disclosed to add an inorganic filler, such as a glass fiber and a carbon fiber, to a resin to be molded, or to use foam molding that uses a high-pressure fluid or a supercritical fluid for a physical blowing agent and causes the blowing agent to foam finely in the resin. Patent Literature 6 proposes a method of injection-molding the spacing member first and causing the spacing member to sufficiently shrink and then bonding the partition member thereto.

CITATION LIST

Patent Literatures

Patent Literature 1: Japanese Patent Publication No. S47-19990

Patent Literature 2: Japanese Patent Publication No. S51-2131

Patent Literature 3: Japanese Patent No. 2690272

Patent Literature 4: Japanese Patent No. 3461697

Patent Literature 5: Japanese Patent Application Laid-open No. 2006-29692

Patent Literature 6: Japanese Patent Application Laid-open No. 2007-100997

SUMMARY

Technical Problem

However, the technique disclosed in Patent Literature 5 has a problem that, when an inorganic filler is added to a resin, warpage and shrinkage of the resin after a molded product has been removed can be suppressed; however, due to a reduction in fluidity of the molten resin, the molding cycle becomes slow and thus mass productivity decreases. Furthermore, there is also a problem that, while the usage of a resin is reduced, the material cost increases for the cost of additives. Because a contact surface of the partition member and the resin of the spacing member is reduced, the adhesiveness therebetween is degraded. Further, there is a problem that, when a supercritical fluid is injected, a special incidental facility is required, and this results in an increase in manufacturing costs. Further, there is a problem that the heat transfer coefficient of the resin-molded part that functions as an extended heat transfer surface (a fin) is reduced and thus the temperature exchange efficiency is also reduced.

In addition, the technique disclosed in Patent Literature 6 has a problem that, when the partition member and the spacing member are bonded to each other, bonding or welding needs to be performed in a state where the partition member is sufficiently tensioned and thus a bonding step becomes complicated, and this results in a reduction in productivity.

The present invention has been achieved in view of the above problems, and an object of the present invention is to obtain a heat exchange element that can be molded by a simple facility and that can reduce the ventilation resistance and improve heat-exchange efficiency and productivity by relieving deflection of the partition member immediately after injection molding with a method as simple as possible.

Solution to Problem

In order to solve the above problems and achieve the object, the present invention is a total heat exchange element in which a spacing member is provided on both sides of a sheet-like partition member to form a flow path and which performs heat exchange between an airflow that flows in a flow path formed on one side of the partition member and an airflow that flows in a flow path formed on another side of the partition member via the partition member, wherein the spacing member is molded integrally with the partition member by using a resin, and the partition member is configured to include a functional layer that has heat conductivity, moisture permeability, and gas shielding property and a heat shrink layer that shrinks at a predetermined temperature or higher.

Advantageous Effects of Invention

The total heat exchange element according to the present invention can be molded by a simple facility and can reduce the ventilation resistance and improve heat-exchange efficiency and productivity by relieving deflection of the partition member immediately after injection molding with a method as simple as possible.

BRIEF DESCRIPTION OF DRAWINGS

FIG. 4-1 is a cross-sectional view taken along line A-A shown in FIG. 3 and is a diagram illustrating a state immediately after the spacing member has been molded and a mold has been removed.

FIG. 4-2 is a cross-sectional view taken along line A-A shown in FIG. 3 and is a diagram illustrating a state where a mold has been removed and then the partition member is heated.

DESCRIPTION OF EMBODIMENTS

A total heat exchange element and a manufacturing method thereof according to the embodiments of the present invention will be explained below in detail with reference to the accompanying drawings. The present invention is not limited to the embodiments.

First Embodiment

Figure 1:
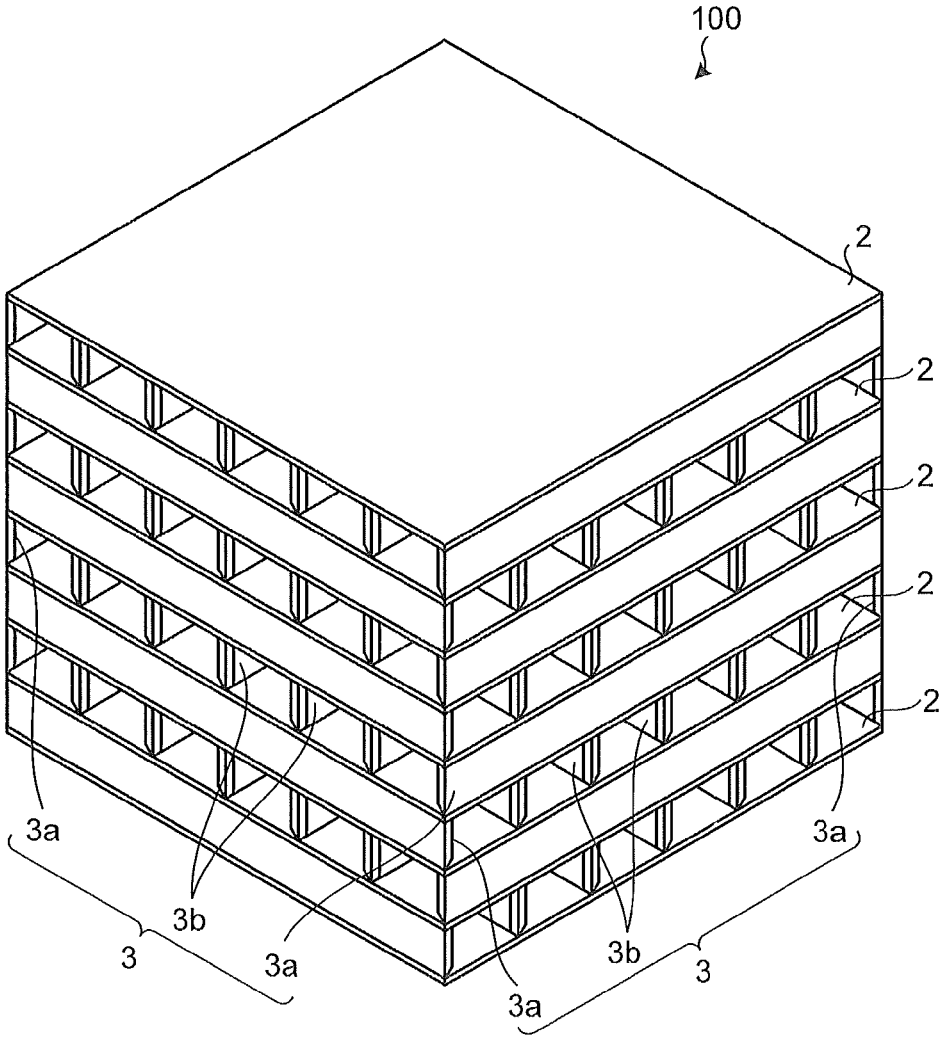
FIG. 1 is a perspective view of a total heat exchange element according to a first embodiment of the present invention.

FIG. 1 is a perspective view of a total heat exchange element according to a first embodiment of the present invention. A total heat exchange element 100 includes partition members 2 and spacing members 3. The total heat exchange element 100 is constituted by alternately stacking unit constituent members, each of which is constituted by the spacing members 3 that keep the partition member 2 at a predetermined distance and the partition member 2, such that the arranging direction of the spacing member 3 is different by 90 degrees.

In the total heat exchange element 100, each layer sandwiched by the partition members 2 functions as a flow path through which air passes, and a flow path through which a primary airflow passes and a flow path through which a secondary airflow passes are alternately constituted. The temperature and humidity are exchanged between the primary airflow and the secondary airflow via the partition member 2.

As will be explained later, the partition member 2 is constituted by bonding a layer (a functional layer) that has heat conductivity, moisture permeability, and gas shielding property and a layer (a heat shrink layer) that has good air permeability and shrinks at a temperature equal to or higher than a certain temperature to each other. The respective elements are explained in detail below.

The partition member 2 serves as a medium that transmits heat and moisture when the temperature and humidity are exchanged between the primary airflow and the secondary airflow. With the configuration explained above, in the total heat exchange element 100, the primary airflow passes along one surface side of the partition member 2 and the secondary airflow passes along the other surface side thereof.

When the primary airflow and the secondary airflow flow, heat (or water vapor) in an airflow on the high temperature side (the high humidity side in the case of moisture) is shifted to the low temperature side (or the low humidity side) via the partition member 2 by using the temperature difference (or the water vapor partial pressure difference). Furthermore, water vapor in an airflow on the high humidity side is shifted to the low humidity side via the partition member 2 by using the water vapor partial pressure difference. Therefore, it is desirable that the partition member 2 be as thin as possible and have a high heat transfer coefficient and a high humidity transfer coefficient.

The partition member 2 is also required to prevent the primary airflow from being mixed with the secondary airflow and to suppress shifting of carbon dioxide, odor components, and the like between the primary and secondary airflows. To satisfy these conditions, a partition member having an air resistance (JIS P8628) of equal to or higher than 200 sec/100 cc and also having a moisture permeability is preferable.

To satisfy these conditions, in the total heat exchange element 100, a water-insoluble hydrophilic polymer thin-film is used for the partition member 2. More specific examples of the material include a polyurethane-based resin containing an oxyethylene group that has a moisture permeability, a polyester-based resin including an oxyethylene group, and a resin containing a sulfonate group, an amino group, a hydroxyl group, and a carboxyl group at a terminal or on a side chain.

Figure 2:
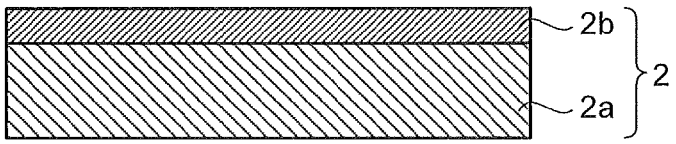
FIG. 2 is a diagram illustrating a cross-sectional configuration of a partition member.

FIG. 2 is a diagram illustrating a cross-sectional configuration of the partition member 2. As shown in FIG. 2, the partition member 2 is constituted by bonding a heat shrink layer 2*a* to a functional layer 2*b* by a processing method such as bonding and heat fusion. A film that has heat conductivity, moisture permeability, and gas shielding property is generally used for the functional layer 2*b*.

A porous film that has good tensile strength and good dimensional stability is used for the heat shrink layer 2*a*. As for the heat shrink layer 2*a*, it is desirable to use a porous film that has good air permeability so as not to decrease its moisture permeability and has a good dimensional stability with respect to a tensile force at the time of processing and a change in humidity.

As explained above, by bonding the functional layer 2*b* and the heat shrink layer 2*a* to each other, deflection of the partition member under a high humidity condition can be prevented by supporting the moisture-permeable films at a distance as small as possible while the moisture permeability of the partition member 2 is secured as much as possible, and the ventilation resistance of an airflow can be reduced.

According to the present embodiment, a material that has, in addition to the functions as a porous film explained above, a function of shrinking by heating is used as the heat shrink layer 2*a*. A material which is part of woven fabrics, non-woven fabrics, or the like formed of a thermoplastic resin, such as an olefin-based resin, and to which a stretching force is applied in a manufacturing step thereof has a characteristic of shrinking when heated to a temperature equal to or higher than a temperature that is unique to the constituent resin (a softening temperature). For example, it is possible to use a material that contains a heat-shrinkable resin (such as a cyclic olefin resin and a polyolefin resin) in a woven fabric or a non-woven fabric or a non-woven fabric that contains therein a latent crimp fiber as the heat shrink layer 2*a*.

The latent crimp fiber is a fiber that has a characteristic of developing spiral crimp by heating at a predetermined temperature so as to shrink. For example, the latent crimp fiber is made of an eccentric sheath-core type conjugate fiber or a side-by-side type conjugate fiber that contains two types of thermoplastic polymer materials with different shrinkage rates as its components. Examples of such fibers include those described in Japanese Patent Application Laid-open No. H9-296325 and Japanese Patent No. 2759331.

As for a heat-shrinkable non-woven fabric, a non-woven fabric that contains, in addition to the latent crimp fiber, other fibers such as rayon, cotton, and a hydrophilic acrylic fiber can be used. A material that has a moisture permeability (the functional layer 2*b*) generally expands or shrinks itself depending on the environmental conditions (such as humidity). However, by bonding the material that has a moisture permeability and a material (the heat shrink layer 2*a*) such as non-woven fabrics explained above to each other, the dimensional stability with respect to a change in humidity can be improved. Furthermore, when the partition member 2 is heated, the entire partition member 2 shrinks along with the shrinkage of the heat shrink layer 2*a*.

It is desirable that the compressive strength of the functional layer 2*b* in a planar direction be sufficiently lower than that of the heat shrink layer 2*a* so as not to hinder the shrinkage of the heat shrink layer 2*a*. The strength of a sheet-like member such as the heat shrink layer 2*a* and the functional layer 2*b* in a planar direction largely depends on the thickness thereof. Therefore, it is desirable that the functional layer 2*b* be much thinner than the heat shrink layer 2*a* (generally, the film thickness of the functional layer 2*b* is equal to or smaller than half the film thickness of the heat shrink layer 2*a*) and that the material strength of the functional layer 2*b* is also lower than that of the heat shrink layer 2*a*.

Figure 3:
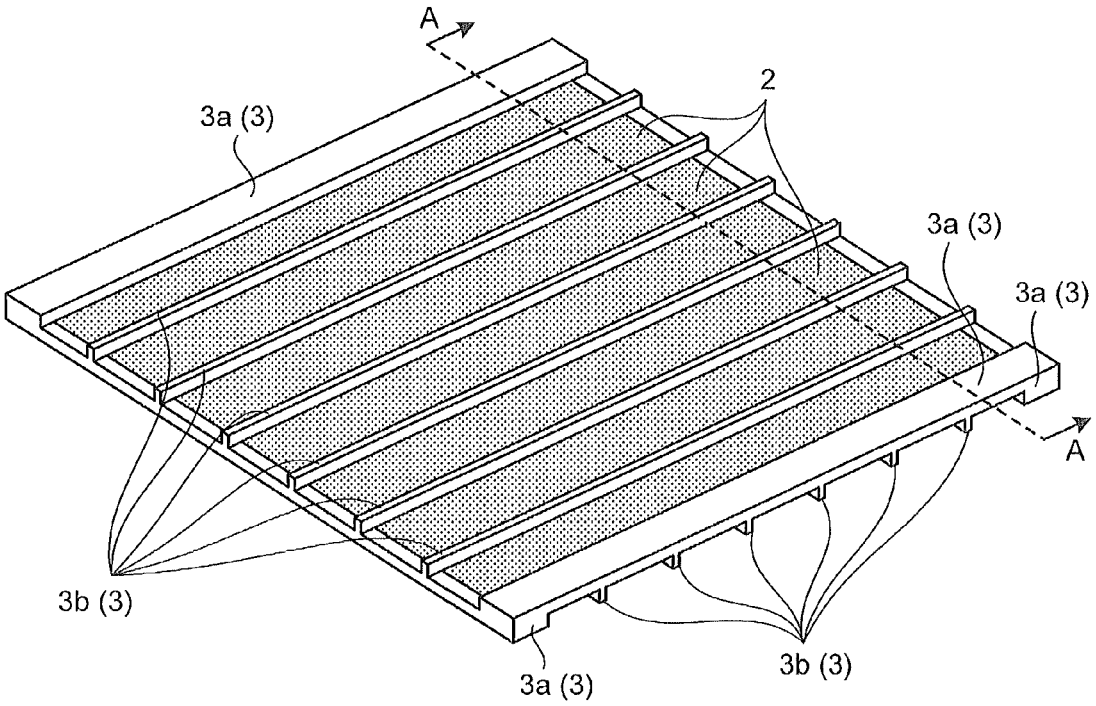
FIG. 3 is a perspective view of an appearance of a unit constituent member that is constituted by spacing members and a partition member.

Next, the spacing member 3 is provided on the partition member 2 having the two layers mentioned above bonded to each other. FIG. 3 is a perspective view of an appearance of a unit constituent member that is constituted by the spacing members 3 and the partition member 2. The spacing member 3 includes shielding ribs 3*a* and spacing ribs 3*b*.

To prevent air leakage from two sides (hereinafter, "both ends") in a direction vertical to a direction in which an airflow flows on a surface of the partition member 2, among four sides of the partition member 2 in a plan view, the shielding rib 3*a* is provided at the both ends. A plurality of the spacing ribs 3*b* are provided between the shielding ribs 3*a* at predetermined intervals so as to be parallel to the shielding ribs 3*a*.

The shielding ribs 3*a* and the spacing ribs 3*b* serving as the spacing member 3 are formed on both surfaces of the partition member 2. The shielding ribs 3*a* and the spacing ribs 3*b* formed on one surface side of the partition member 2 are provided so as to be perpendicular to the shielding ribs 3*a* and the spacing ribs 3*b* formed on the other surface side of the partition member 2. The spacing member 3 is made of a resin.

The unit constituent member shown in FIG. 3 is manufactured by integrally molding the partition member 2 and the spacing members 3. Specifically, the spacing member 3 is directly resin-molded with respect to the partition member 2. For example, before resin molding, the partition member 2 is put in a mold having shapes of the shielding ribs 3*a* and the spacing ribs 3*b* carved therein and is then molded, whereby the unit constituent member is manufactured. When the unit constituent member is stacked on the partition member 2, the spacing member 3 maintains the distance between the partition members 2. The shielding ribs 3*a* and the spacing ribs 3*b* formed on one surface side of the partition member 2 may be provided so as to obliquely intersect the shielding ribs 3*a* and the spacing ribs 3*b* on the other surface side of the partition member 2.

Examples of a resin used for the spacing member 3 include polypropylene (PP), acrylonitrile-butadiene-styrene (ABS), polystyrene (PS), acrylonitrile-styrene (AS), polycarbonate (PC), and other general types of resin that can be molded in a desired shape.

At the time of molding the spacing member 3, it is necessary to set the condition such that the mold temperature does not exceed the heat shrink temperature of the heat shrink layer 2*a* of the partition plate. If the mold temperature exceeds the heat shrink temperature, the heat shrink layer 2*a* of the partition member shrinks before the shrinkage of the spacing member 3 after molding is started, and thus the object of the invention cannot be achieved. In other words, a material whose heat-shrinkage start temperature is higher than the mold temperature at the time of molding the spacing member 3 is used for the heat shrink layer 2*a*.

As described above, by molding the spacing member 3 with a resin, deformation of the spacing member 3 caused by humidity can be suppressed and thus the shape of the ventilation path can be stabilized. Furthermore, a flame retardant may be added to the resin to make the resin flame retardant and an inorganic component may be added to the resin to improve the dimensional stability and strength. In addition, depending on the purpose, a blowing agent (a physical blowing agent/a chemical blowing agent) may be added to the resin to foam the resin in order to reduce the amount of the resin and the like.

Figures 1, 4:
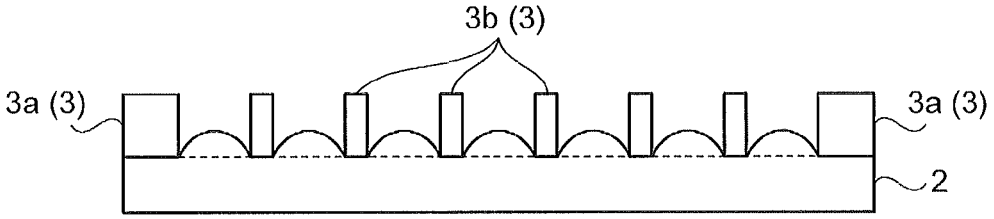
Figures 2, 4:
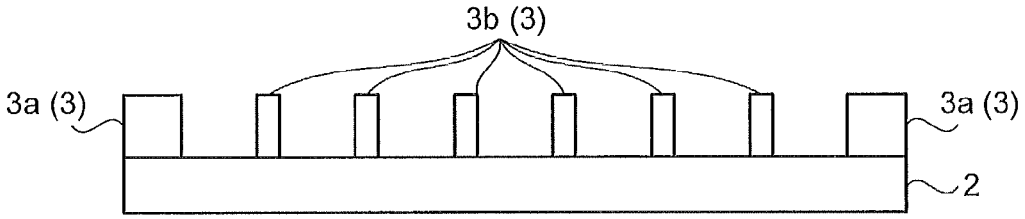

FIG. 4-1 is a cross-sectional view taken along line A-A shown in FIG. 3 and is a diagram illustrating a state immediately after the spacing member 3 has been molded and a mold has been removed. FIG. 4-2 is a cross-sectional view taken along line A-A shown in FIG. 3 and is a diagram illustrating a state where a mold has been removed and then the partition member 2 is heated.

As shown in FIG. 4-1, immediately after the spacing member 3 has been molded and the mold has been removed, deflection is generated in some cases on the surface of the partition member 2. Therefore, by heating the partition member 2 to cause the heat shrink layer 2*a* to shrink, deflection generated immediately after the mold has been removed is eliminated as shown in FIG. 4-2.

A heating method of the partition member 2 is not particularly limited as long as it is a method being capable of heating the partition member 2 to a temperature equal to or higher than a heat shrink temperature set for each substance that constitutes the heat shrink layer 2*a*. However, in a case where the entire unit constituent member is heated at a time, when the heat shrink temperature of the heat shrink layer 2*a* is equal to or higher than the softening temperature of the resin that constitutes the spacing member 3, the spacing member 3 may be softened before the shrinkage of the partition member 2.

If the spacing member 3 is softened first, the spacing member 3 is deformed in some cases by the shrinkage force that is generated when the partition member 2 shrinks. Therefore, the heat shrink temperature of the heat shrink layer 2*a* of the partition member 2 is desirably equal to or lower than the softening temperature of the spacing member 3.

Figure 5:
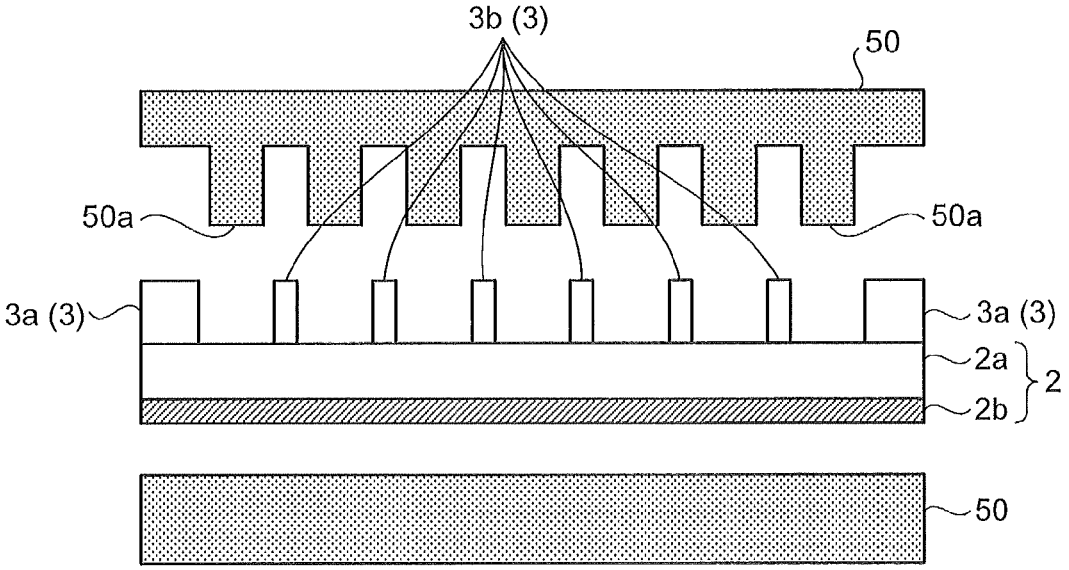
FIG. 5 is an explanatory diagram of a heating member that heats the partition member.

FIG. 5 is an explanatory diagram of a heating member that heats the partition member 2. For example, a heating member 50 shown in FIG. 5 is a metal plate having concave portions and convex portions formed therein corresponding to the shape of the spacing member 3. The concave portions and convex portions of the heating member 50 are formed such that, when the heating member 50 is pressed against the partition member 2, only tips 50*a* of the convex portions come into contact with the partition member 2 and the heating member 50 hardly comes into contact with the spacing member 3.

By bringing the heating member 50 serving as a heat source into contact with the heat shrink layer 2*a* side of the partition member 2, the partition member can be heated without heating the spacing member 3. Therefore, like the heating member 50, when the partition member 2 can be heated without heating the spacing member 3, even in a case where the heat shrink temperature of the heat shrink layer 2*a* is equal to or higher than the softening temperature of the resin that constitutes the spacing member 3, deformation of the spacing member 3 can be suppressed and thus deflection of the partition member 2 can be eliminated.

The heat shrinkage rate of the heat shrink layer 2*a* is desirably equal to or higher than that of the resin used as the spacing member 3 after molding. When the heat shrinkage rate of the heat shrink layer 2*a* is small, the amount of shrinkage required for eliminating deflection cannot be obtained and it may be difficult to eliminate the deflection of the partition member 2. On the other hand, when the heat shrinkage rate of the heat shrink layer 2*a* is large, the amount of shrinkage required for eliminating deflection is easily obtained. Even when the amount of shrinkage is much larger than the amount of shrinkage required for eliminating deflection, because the amount of shrinkage can be adjusted by adjusting the heating time of the heat shrink layer 2*a*, the deflection can be eliminated more completely.

Figure 6:
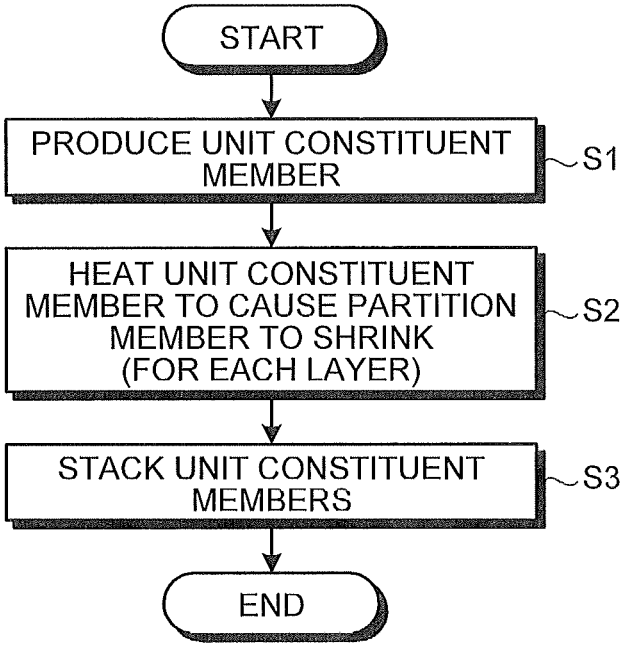
FIG. 6 is a flowchart of a manufacturing procedure of the total heat exchange element according to the first embodiment of the present invention.

FIG. 6 is a flowchart of a manufacturing procedure of the total heat exchange element 100 according to the first embodiment of the present invention. First, the partition member 2 and the spacing members 3 are integrally molded to produce unit constituent members (Step S1). Next, for each of the unit constituent members, the partition member 2 is heated by the heating member 50 to eliminate deflection thereof (Step S2). Next, these unit constituent members are stacked and fixed to each other by bonding, heat fusion, or the like (Step S3). As a result, the total heat exchange element 100 shown in FIG. 1 is manufactured.

These unit constituent members are stacked such that the direction in which the spacing member extends (direction of a flow path) is changed by 90 degrees (vertically) every layer. In the first embodiment, as shown in FIG. 3, the spacing member 3 is integrally molded on both surfaces of the partition member 2 so as to produce the unit constituent member. Therefore, at Step S3, the partition member 2 without the spacing member 3 being formed thereon and the unit constituent member are alternately stacked. On the other hand, when the spacing member 3 is integrally molded only on one surface of the partition member 2 to produce the unit constituent member, it is satisfactory to stack only these unit constituent members.

When the unit constituent member is heated and overshrunk, even in a case where the spacing member 3 has not been softened by heat, the unit constituent member is elastically deformed, thereby causing warpage and the like. When the unit constituent member is warped, the stacked bonding surface becomes uneven, and depending on the shape of the warp, a part of the stacked surface may not be bonded.

The part that cannot be bonded becomes a space in the fluid path and fluid escapes to other fluid paths. It is not preferable for a total heat exchanger that the fluid escape to other fluid paths and then the primary airflow be mixed with the secondary airflow because odor, carbon dioxide, and other undesired gases from discharged air are mixed with air to be supplied to rooms. Therefore, the heating time of the partition member needs to be adjusted appropriately.

The total heat exchange element 100 manufactured as explained above has a collective configuration in which each of the fluid path through which the primary airflow passes and the fluid path through which the secondary airflow flows is constituted every other layer between respective layers as shown in FIG. 1, and the respective fluid paths are constituted such that small paths whose path cross sections are large and small substantially-rectangular shapes are alternately arranged.

By obtaining the total heat exchange element 100 with such a manufacturing method, the cross section of the flow path first becomes a rectangular shape. Therefore, the equivalent diameter (the size of a circular tube that is substituted for a rectangular flow path and has a pressure loss equivalent to the rectangular flow path, and it is calculated as 4S/L, where a flow path cross-sectional area is denoted as S and a circumferential length of the flow path is denoted as L) of the rectangular flow path becomes larger that that of a triangular flow path that has the same layer height and the same thread pitch as the rectangular flow path; therefore, there is an effect that the pressure loss is reduced.

Furthermore, because deflection of the partition member 2 due to the shrinkage of the resin after molding can be eliminated by heating the partition member 2 to shrink, the pressure loss is reduced as compared to a case where deflection of the partition member 2 remains. When deflection of the partition member 2 remains, the partition member 2 cannot sufficiently exhibit a total heat-exchange function in some cases. However, when the deflection is eliminated, the surface of the partition member 2 is used more effectively and heat exchange efficiency and humidity exchange efficiency can be improved.

Further, because any special facility such as that used for foam molding is not required and only a simple facility that heats the partition member 2 is required, the facility investment can be minimized and the manufacturing costs can be also suppressed.

A total heat exchange element exemplified below was manufactured by the manufacturing method explained above. As the functional layer 2*b* of the partition member having heat conductivity, moisture permeability, and gas shielding property, a polyurethane-based resin that contains 30% of an oxyethylene group (having a film thickness of about 20 micrometers) was used. As the heat shrink layer 2*a*, a heat-shrinkable non-woven fabric made of a latent crimp fiber [a heat-shrinkable sheath-core conjugate fiber containing an ethylene-propylene random copolymer (EP) as a core component and polypropylene (PP) as a sheath component, manufactured by DAIWABO CO., LTD., with a heat-shrinkage start temperature of about 90° C.] was used.

The functional layer 2*b* and the heat shrink layer 2*a* were laminated to each other by heat so as to produce the partition member 2, and the partition member 2 was then cut to an appropriate dimension and set in a mold, and an acrylonitrile-butadiene-styrene resin (ABS) [EX120 manufactured by UMB ABS, Ltd., with a heat deformation temperature of about 80° C.] was injection-molded, thereby integrally molding the spacing member 3.

The unit constituent member was formed such that the shielding ribs 3*a* and the spacing ribs 3*b* extend in different directions on the front surface and the rear surface of the partition member 2 by 90 degrees between them (orthogonal to each other). The completed unit constituent member, was heated by the heating member 50. The tips 50*a* of the heating member 50 were pressed against the heat shrink layer 2*a* of the partition member 2 for an arbitrary period of time to heat shrink the heat shrink layer 2*a*, thereby eliminating deflection of the partition member 2. The unit constituent members were then stacked on each other, methyl ethyl ketone (MEK) was applied to the portions of four peripheral sides of the respective unit constituent members that come into contact with each other when stacked and was welded, thereby obtaining a heat exchange element.

Second Embodiment

Figure 7:
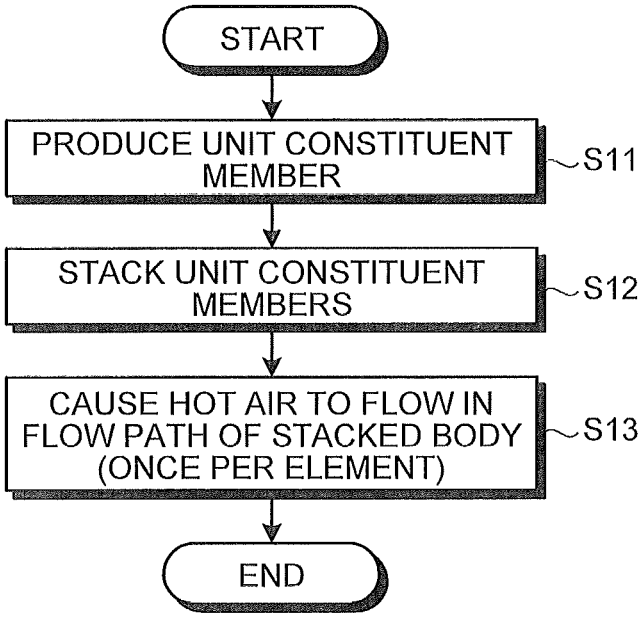
FIG. 7 is a flowchart of a manufacturing procedure of a total heat exchange element according to a second embodiment of the present invention.

FIG. 7 is a flowchart of a manufacturing procedure of a total heat exchange element according to a second embodiment of the present invention. Materials to be used and the like are substantially the same as those in the first embodiment. The difference is that while an ABS resin is used to mold the spacing member 3 in the first embodiment, a PP resin is used instead to produce the unit constituent members in the second embodiment.

The heat deformation temperature of the ABS resin is almost equal to the heat-shrinkage start temperature (about 90° C.) of the heat shrink layer 2*a* of the partition member 2. Therefore, according to the first embodiment, only the partition member 2 is heated by the heating member 50 to suppress deformation of the spacing member 3.

On the other hand, the heat deformation temperature (about 115° C.) of the PP resin used for the spacing member 3 in the second embodiment is higher than the heat-shrinkage start temperature (about 90° C.) of the heat shrink layer 2*a*. In this way, the heat deformation temperature of the spacing member 3 is higher than the heat-shrinkage start temperature of the heat shrink layer 2*a* of the partition member 2. Therefore, when the whole unit constituent member is heated at a temperature that is equal to or higher than the heat shrink temperature of the heat shrink layer 2*a* and lower than the heat deformation temperature of the spacing member 3, deflection of the partition member 2 can be eliminated while deformation of the spacing member 3 is suppressed.

In the second embodiment, a total heat exchange element is manufactured by the following procedure. Unit constituent members are produced first (Step S11), and the unit constituent members are then stacked and bonded to each other before the heating step (Step S12), thereby completing the whole configuration of the total heat exchange element.

Next, air having a temperature that is equal to or higher than the heat shrink temperature of the heat shrink layer 2*a* and lower than the heat deformation temperature of the spacing member 3 is caused to flow in a first flow path and a second flow path of the completed total heat exchange element 100 (Step S13), so that deflection of the partition members 2 stacked in multiple layers can be eliminated at a time.

With this method, control of the amount of deflection of the partition member 2 can be adjusted by the time during which high temperature air flows. Because the total heat exchange element is heated after the whole configuration thereof has been completed, that is, after the rigidity of the entire total heat exchange element has been secured, even when the time during which high temperature air flows is extended and thus the partition member 2 shrinks excessively, the respective layers are not easily deformed.

According to the first embodiment, when the unit constituent member is deformed due to the excessive shrinkage of the partition member, workability thereafter is sometimes impaired. On the other hand, according to the second embodiment, because the respective layers are not easily deformed as explained above, the production efficiency can be improved. Further, because deflection of the respective layers can be eliminated at a time, the production efficiency can be further improved.

A total heat exchange element exemplified below was manufactured by the manufacturing method explained above. As the functional layer 2*b* of the partition member 2 that has heat conductivity, moisture permeability, and gas shielding property, a polyurethane-based resin (having a film thickness of about 20 micrometers) was used. As the heat shrink layer 2*a*, a heat-shrinkable non-woven fabric made of a latent crimp fiber [a heat-shrinkable sheath-core conjugate fiber containing an ethylene-propylene random copolymer (EP) as a core component and polypropylene (PP) as a sheath component, manufactured by DAIWABO CO., LTD., with a heat-shrinkage start temperature of about 90° C.] was used.

The functional layer 2*b* and the heat shrink layer 2*a* were laminated to each other by heat so as to produce the partition member 2, and the partition member 2 was then cut to an appropriate dimension and set in a mold, and a polypropylene resin (PP) [MA3H manufactured by Japan Polypropylene Corporation, with a heat deformation temperature of about 115° C.] was injection-molded, thereby integrally molding the spacing member 3.

The unit constituent member was formed such that the shielding ribs 3*a* and the spacing ribs 3*b* extend in different directions on the front surface and the rear surface of the partition member 2 by 90 degrees between them (orthogonal to each other). The completed unit constituent members were stacked on each other and methyl ethyl ketone (MEK) was applied to the portions of four peripheral sides of the respective unit constituent members that come into contact with each other when stacked and was welded, thereby completing the whole configuration of a heat exchange element. Air adjusted to be 100° C., which is higher than the heat-shrinkage start temperature of the heat shrink layer 2*a* and lower than the heat deformation temperature of the spacing member 3, was caused to flow in a first flow path and a second flow path, thereby eliminating deflection of the partition member 2.

INDUSTRIAL APPLICABILITY

As described above, the total heat exchange element according to the present invention is useful as a total heat exchange element in which the partition member and the spacing member are integrally molded.

REFERENCE SIGNS LIST

2 partition member
2*a* heat shrink layer
2*b* functional layer
3 spacing member
3*a* shielding rib
3*b* spacing rib
50 heating member
50*a* tip
100 total heat exchange element

The invention claimed is:

1. A total heat exchange element in which a spacing member is provided on opposite sides of a sheet-like partition member to form a flow path and which performs heat exchange between an airflow that flows in a flow path formed on one side of the partition member and an airflow that flows in a flow path formed on another side of the partition member via the partition member, wherein the spacing member is molded integrally with the partition member by using a resin, the partition member is configured to include a functional layer that has heat conductivity, moisture permeability, and gas shielding property and a heat shrink layer that shrinks at a predetermined temperature or higher, and the heat shrink layer comprises a non-woven fabric, and a heat shrinkage rate of the non-woven fabric is larger than a heat shrinkage rate of the resin that is used as the spacing member.

2. The total heat exchange element according to claim 1, wherein a heat-shrinkage start temperature of the partition member is higher than a mold temperature at a time of molding the spacing member and lower than a softening temperature of a resin that is used as the spacing member.

3. The total heat exchange element according to claim 1, wherein the non-woven fabric includes a latent crimp fiber.

4. A manufacturing method of a total heat exchange element in which a spacing member is provided on opposite sides of a sheet-like partition member to form a flow path and which performs heat exchange between an airflow that flows in a flow path formed on one side of the partition member and an airflow that flows in a flow path formed on another side of the partition member via the partition member, the manufacturing method comprising:

a step of producing the partition member by stacking a functional layer that has heat conductivity, moisture permeability, and gas shielding property and a heat shrink layer that shrinks at a predetermined temperature or higher;

a step of producing a unit constituent member by molding the spacing member integrally with the partition member by using a resin;

a step of heating the heat shrink layer of the unit constituent member to the predetermined temperature or higher; and a step of stacking the unit constituent members after the step of heating to the predetermined temperature or higher.

5. The manufacturing method of a total heat exchange element according to claim 4, wherein the step of heating the heat shrink layer to the predetermined temperature or higher is performed by using a heating member that comes into contact with the heat shrink layer, without contacting the spacing member, of the unit constituent member.

6. The manufacturing method of a total heat exchange element according to claim 4, wherein in the step of heating, the heat shrink layer is heated without heating the spacing member.

7. A manufacturing method of a total heat exchange element in which a spacing member is provided on opposite sides of a sheet-like partition member to form a flow path and which performs heat exchange between an airflow that flows in a flow path formed on one side of the partition member and an airflow that flows in a flow path formed on another side of the partition member via the partition member, the manufacturing method comprising:

a step of producing the partition member by stacking a functional layer that has heat conductivity, moisture permeability, and gas shielding property and a heat shrink layer that shrinks at a predetermined temperature or higher;

a step of stacking unit constituent members comprising the spacing member and the partition member; and a step of causing air having the predetermined temperature or higher to flow in the flow path after the step of stacking the unit constituent members.

8. The manufacturing method of a total heat exchange element according to claim 7, wherein a heat deformation temperature of the spacing member is higher than a heat-shrinkage start temperature of the heat shrink layer, which shrinks at a predetermined temperature or higher of the partition member.

* * * * *